US010232327B2

(12) United States Patent
Pappalardo

(10) Patent No.: US 10,232,327 B2
(45) Date of Patent: Mar. 19, 2019

(54) FLOW INVERTER BAFFLE AND ASSOCIATED STATIC MIXER AND METHODS OF MIXING

(71) Applicant: Nordson Corporation, Westlake, OH (US)

(72) Inventor: Matthew E. Pappalardo, Ewing, NJ (US)

(73) Assignee: Nordson Corporation, Westlake, OH (US)

( * ) Notice: Subject to any disclaimer, the term of this patent is extended or adjusted under 35 U.S.C. 154(b) by 309 days.

(21) Appl. No.: 15/059,535

(22) Filed: Mar. 3, 2016

(65) Prior Publication Data

US 2017/0252708 A1 Sep. 7, 2017

(51) Int. Cl.
*B01F 5/06* (2006.01)

(52) U.S. Cl.
CPC ..... *B01F 5/061* (2013.01); *B01F 5/0641* (2013.01); *B01F 2005/062* (2013.01)

(58) Field of Classification Search
CPC ..... B01F 5/061
USPC ..... 366/336–340
See application file for complete search history.

(56) References Cited

U.S. PATENT DOCUMENTS 1,496,896 A * 6/1924 Laffoon ..... B02B 1/04 366/337
3,239,197 A 3/1966 Tollar
3,328,003 A * 6/1967 Chisholm ..... B01F 5/0641 138/42
5,851,067 A 12/1998 Fleischli et al.
5,944,419 A 8/1999 Streiff
6,599,008 B2 7/2003 Heusser et al.
6,773,156 B2 8/2004 Henning
7,322,740 B2 1/2008 Heusser et al.
7,325,970 B2 2/2008 Keller
7,985,020 B2 7/2011 Pappalardo
8,083,397 B2 * 12/2011 Pappalardo ..... B01F 5/064 366/337
9,724,653 B2 * 8/2017 Pappalardo ..... B01F 5/0606
2003/0048694 A1 * 3/2003 Horner ..... B01F 5/0617 366/337
2013/0003494 A1 * 1/2013 Kirk ..... B01F 5/0641 366/337

* cited by examiner

*Primary Examiner* — David L Sorkin
(74) *Attorney, Agent, or Firm* — Baker & Hostetler LLP

(57) ABSTRACT

A static mixer includes at least one flow inverter baffle. The flow inverter baffle includes a first dividing panel to divide the fluid flow into a first flow portion adjacent a first side of the first dividing panel and a second flow portion adjacent a second side of the first dividing panel. The flow inverter baffle also includes a dividing element to divide the second flow portion into first and second perimeter flow portions. Additionally, first, second and third inversion elements to invert the flow layers of the at least two components by shifting the fluid flow to a different portion of a flow cross-section within the mixer while maintaining the general orientation of the flow layers as the fluid flow moves progresses through the flow inverter baffle. The flow inverter baffle also reduces backpressure by limiting the total amount of movement to cause the inversion.

27 Claims, 12 Drawing Sheets

FLOW INVERTER BAFFLE AND ASSOCIATED STATIC MIXER AND METHODS OF MIXING

TECHNICAL FIELD

This disclosure generally relates to a fluid dispenser and more particularly, to components of a static mixer and methods of mixing fluid flows.

BACKGROUND

A number of motionless mixer types exist, such as Multiflux, helical and others. These mixer types, for the most part, implement a similar general principle to mix fluids together. In these mixers, fluids are mixed together by dividing and recombining the fluids in an overlapping manner. This action is achieved by forcing the fluid over a series of baffles of alternating geometry. Such division and recombination causes the layers of the fluids being mixed to thin and eventually diffuse past one another, eventually resulting in a generally homogenous mixture of the fluids. This mixing process has proven to be very effective, especially with high viscosity fluids.

Static mixers are typically constructed of a series of alternating baffles, of varying geometries, usually consisting of right-handed and left-handed mixing baffles located in a conduit to perform the continuous division and recombination. Such mixers are generally effective in mixing together most of the mass fluid flow, but these mixers are subject to a streaking phenomenon, which has a tendency to leave streaks of completely unmixed fluid in the extruded mixture. The streaking phenomenon often results from streaks of fluid forming along the interior surfaces of the mixer conduit that pass through the mixer essentially unmixed.

There have been attempts made to maintain adequate mixer length while trying to address the streaking phenomenon. For example, the traditional left-handed and right-handed mixing baffles can be combined with baffles causing greater angles of rotation of the flow (180° or 270° baffles) and/or combined with flow inversion baffles, such as the specialized inverter baffles described in U.S. Pat. No. 7,985,020 to Pappalardo and U.S. Pat. No. 6,773,156 to Henning. Each of these latter types of baffles tends to force the fluid from the periphery into the center of the mixing baffles, and vice versa. While such approaches do reduce the size of streaks moving through the static mixer, the mixing is less efficient because the movement of all central flow to the periphery and all peripheral flow to the center requires significant shifting movement of the entire fluid flow moving through these flow inversion baffles, which can in some instances increase the backpressure in the static mixer in a significant manner. Moreover, when the fluid flow includes alternating layers of at least two components, the high amount of flow shifting caused by known flow inversion baffles can lead to layer disruption or jumbling together of the layers in such a manner that may produce additional flow streaks that must later be diffused by other mixing elements in the static mixer, thereby increasing the total length of a mixer.

Therefore, it would be desirable to further enhance the flow shifting or inverting mixing elements used with static mixers of this general type, so that the mixing performance is further optimized at each mixing element and so that the increase in backpressure may be minimized.

SUMMARY

In accordance with one embodiment, flow inverter baffle is configured to mix a fluid flow having at least two components. The flow inverter baffle includes a leading edge, a trailing edge, a first dividing panel, one or more compressing elements, a dividing element, and first, second and third inversion elements. The flow inverter baffle defines a transverse flow cross-section perpendicular to the fluid flow along an entire length between the leading and trailing edges. The first dividing panel is adjacent to the leading edge and has first and second sides. The first dividing panel is configured to divide the fluid flow into a first flow portion adjacent the first side of the first dividing panel and a second flow portion adjacent the second side of the first dividing panel. One or more compressing elements are configured to compress the first flow portion. A first inversion element is located downstream of the one or more compressing elements. The first inversion element is configured to shift the first flow portion to a different location with respect to the transverse flow cross-section. A dividing element is located adjacent the second side of the first dividing panel and is configured to divide the second flow portion into first and second perimeter flow portions. A second inversion element is configured to shift the first perimeter flow portion. Similarly, a third inversion element is configured to shift the second perimeter flow portion. Accordingly, an entirety of the fluid flow is shifted to another portion of the mixer conduit by the flow inverter baffle.

The first flow portion may be the lower flow portion, such that the first inversion element is configured to shift the entirety of the first flow portion upwardly with respect to the transverse flow cross-section to a different location with respect to the transverse flow cross-section. The first perimeter flow portion may be the upper left flow portion, such that the second inversion element is configured to shift the upper left flow portion downwardly with respect to the transverse flow cross-section to a different location. Similarly, the second perimeter flow portion may be the upper right flow portion, such that the third inversion element is configured to shift the upper right flow portion downwardly with respect to the transverse flow cross-section to a different location.

The flow inverter baffle may include a second dividing panel located adjacent to the trailing edge. The second dividing panel is configured to separate the first flow portion from the first and second perimeter flow portions.

The first inversion element may include an occluding wall generally parallel with respect to the transverse flow cross-section. The occluding wall is configured to shift the first flow portion upwardly with respect to the transverse flow cross-section and adjacent to the first side of the second dividing panel. The second inversion element is located in the upper left quadrant and is configured to shift the first perimeter flow portion downwardly with respect to the transverse flow cross-section and then along the left side of the second dividing panel. The third inversion element is located in the upper right quadrant and is configured to shift the second perimeter flow portion downwardly with respect to the transverse flow cross-section and then along the right side of the second dividing panel.

The flow inverter baffle may include a central passageway located between the one or more compressing elements and the first inverter element. The central passageway is configured to allow the first flow portion to flow upwardly toward the first side of the dividing panel.

The first and second perimeter flow portions may be recombined prior to reaching the trailing edge of the flow inverter baffle, while the first flow portion remains separate from the first and second perimeter flow portions prior to reaching the trailing edge of the flow inverter baffle.

The second and third inversion elements may be collectively formed from a single surface. The first dividing panel may include a tapered or sharpened end at the leading edge to help reduce backpressure.

The dividing element may be centered horizontally with respect to the transverse flow cross-section, which allows the second flow portion to be divided equally between the first and second perimeter flow portions. Alternatively, the dividing element may be off-center horizontally with respect to the transverse flow cross-section. In either embodiment, the first dividing panel may be off-center vertically with respect to the transverse flow cross-section.

The flow inverter baffle may include one or more windows located in the second dividing panel. The one or more windows are configured to recombine the first and second perimeter flow portions with the first flow portion. The one or more compression elements may include first and second oppositely angled surfaces which collectively form a funnel-shape to compress the first flow portion.

The first and second dividing panels, the one or more compressing surfaces, the dividing element, and the first, second and third inversion elements may be integrally formed as a unitary piece and/or be injection molded. Similarly, the plurality of mixing baffles and the at least one flow inverter baffle may be integrally formed as a unitary piece and/or be formed by injection molding. Additionally, a conduit sidewall may be integrally formed with the plurality of mixing baffles and the at least one flow inverter baffle.

In another aspect of the present invention, a static mixer is described for mixing a fluid flow having at least two components. The static mixer includes a mixer conduit configured to receive the fluid flow, a plurality of mixing baffles located in the conduit, and at least one flow inverter baffle located in the conduit according to one or more of the embodiments described above. The plurality of mixing baffles may include alternating mixing baffles, such as at least one right-handed baffle and at least one left-handed baffle.

In another aspect of the present invention, a method of mixing at least two components of a fluid flow with a static mixer is described. The static mixer includes a mixer conduit, a plurality of mixing baffles and at least one flow inverter baffle. The method includes introducing the fluid flow having at least two components into an inlet end of the mixer conduit. The method further includes forcing the fluid flow through the plurality of mixing baffles to produce a mixed fluid flow, which includes forcing the fluid flow through the at least one flow inverter baffle that includes a leading edge and a trailing edge, the flow inverter baffle defining a transverse flow cross-section perpendicular to the fluid flow along an entire length between the leading and trailing edges. The method further includes dividing the fluid flow with a first dividing panel adjacent to the leading edge into first and second flow portions, such that the first flow portion flows along a first side of the first dividing panel and the second flow portion flows along a second side of the first dividing panel. The method further includes inverting the first flow portion with a first inversion element located adjacent the first side of the first dividing panel to a different location with respect to the transverse flow cross-section. The method further includes dividing the second flow portion into first and second perimeter flow portions with a dividing element located adjacent the second side of the first dividing panel. The method further includes inverting the first perimeter flow portion with a second inversion element to a different location. The method further includes inverting the second perimeter flow portion with a third inversion element to a different location. The method thereby inverts the flow layers of the at least two components as a result of flow through the at least one flow inverter baffle, while maintaining a general orientation of the flow layers as the fluid flow moves through the at least one flow inverter baffle.

The flow inverter baffle may include a second dividing panel located adjacent to the trailing edge and having first and second sides. Further, the first flow portion is the lower flow portion, the first perimeter flow portion is the upper left flow portion and the second perimeter flow portion is the upper right flow portion. Inverting the first flow portion, the first perimeter flow portion, and the second perimeter flow portion further includes inverting the first flow portion upwardly with respect to the transverse flow cross-section using the first inversion element located in the second side of the first dividing panel, and then expanding the first flow portion adjacent the second side of the dividing panel. The method further includes inverting the first perimeter flow portion downwardly with respect to the transverse flow cross-section using the second inversion element located in an upper left quadrant, and then adjacent a first wall of the first inversion element. The method further includes inverting the second perimeter flow portion downwardly with respect to the transverse flow cross-section using the third inversion element located in an upper right quadrant, and then adjacent a second wall of the first inversion element.

These and other objects and advantages of the apparatus and methods described herein will become more readily apparent during the following detailed description taken in conjunction with the drawings herein.

DETAILED DESCRIPTION

Figure 1:
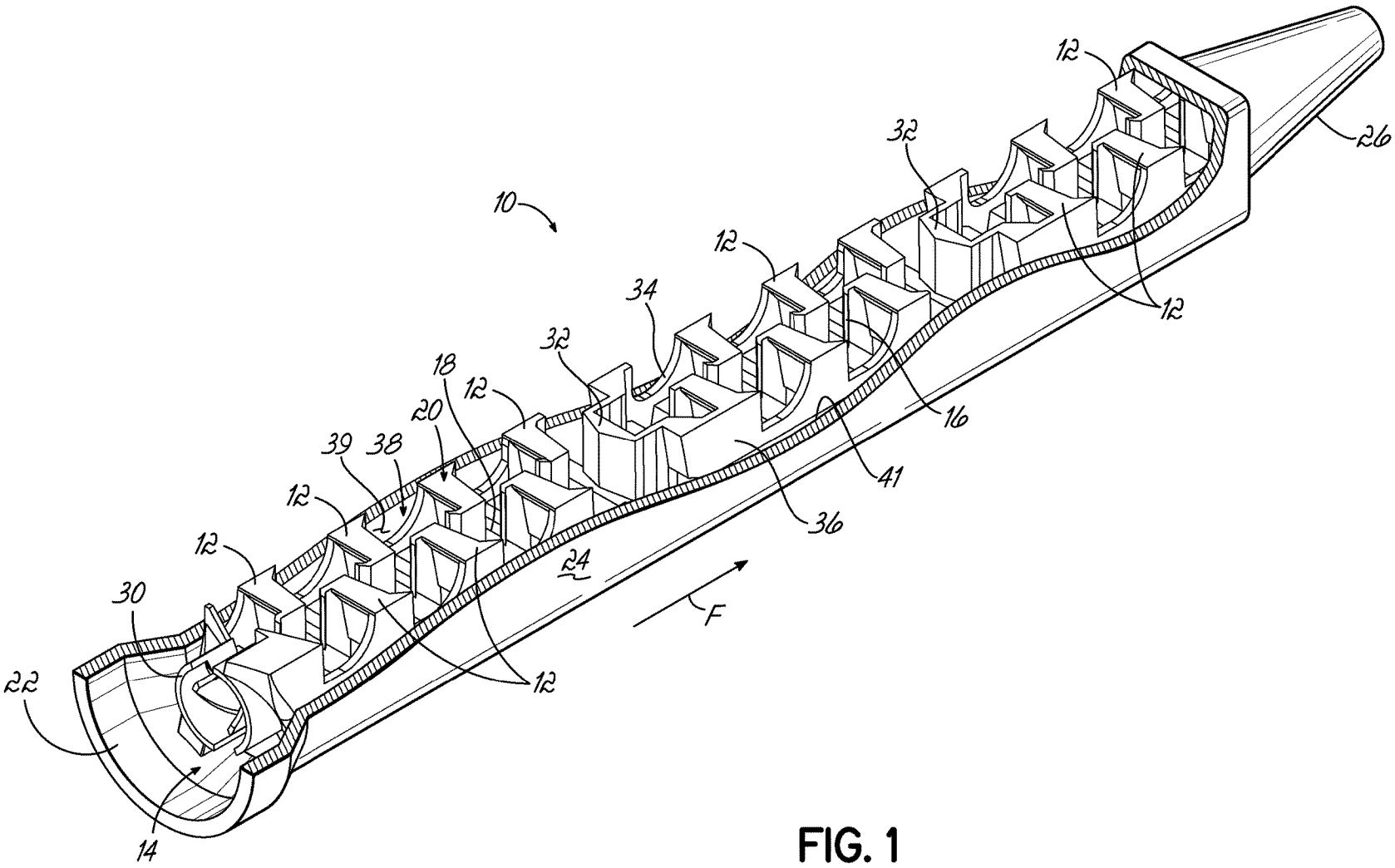
FIG. 1 is a perspective view of a static mixer with a portion of the mixer sidewall removed so as to reveal a mixing component including multiple double wedge mixing baffles and two flow inverter baffles and in accordance with one embodiment of the invention.

FIG. 1 illustrates one embodiment of a static mixer 10 including a series of "double wedge" mixing baffles 12 and at least one flow inverter baffle 32. The double wedge mixing baffles 12 are shown and described in detail in U.S. patent application Ser. No. 14/620,227, filed on Feb. 12, 2015, and which is assigned to the assignee of this application and is hereby incorporated by reference herein. This application therefore will focus on the flow inverter baffles 32, 210 (shown in FIGS. 12 and 13), 310 (shown in FIG. 14) according to various exemplary embodiments of the present invention. As will be described in greater detail below, each embodiment of the flow inverter baffle 32, 210, 310 is configured to shift at least a portion of the fluid flow from one side of the mixer conduit 14 to another side of the mixer conduit 14, thereby providing a different type of fluid movement and mixing, contrasting with the double wedge mixing baffles 12. Further, as described below, the flow inverter baffle advantageously "shuffles" the fluid flow and moves any fluid streaks in the fluid flow from the central region to the outer periphery, or vice versa, while maintaining the general orientation of the fluid layers defined by multiple components of the fluid flow.

With continued reference to FIG. 1, the static mixer 10 generally includes a mixer conduit 14 and a mixing component 20, which is inserted into the mixer conduit 14. The mixer conduit 14 defines an inlet end 22 configured to be attached to a cartridge, cartridge system, or metering system (none of which are shown) containing at least two fluids (also referred to as components) to be mixed together. The fluid flow F having at least two components enters an inlet end 22 of the mixer conduit 14. For example, the inlet end 22 may be connected to any of the two-component cartridge systems available from Nordson Corporation of Westlake, Ohio. The mixer conduit 14 also includes a body section 24 shaped to receive the mixing component 20 and a nozzle outlet 26 communicating with the body section 24. Although the body section 24 and mixing component 20 are shown as having substantially square cross-sectional profiles, those skilled in the art will appreciate that the concepts described below may equally apply to mixers with other geometries, including round or cylindrical as well as others.

The mixing component 20, contained within the static mixer 10 of the embodiment shown in FIG. 1, includes a series of mixing elements and/or baffles. This series of mixing elements and/or baffles begins with an entry mixing element 30 adjacent to the inlet end 22 and which is configured to ensure some initial division and mixing of the at least two fluids received in the static mixer 10 (regardless of the orientation of the mixing component 20 relative to the incoming fluid flows), and then continues with a series of left-handed and right-handed versions (labeled $\mathbf{12}_L$ and $\mathbf{12}_R$ below) of the double wedge mixing baffle 12, with a flow inverter baffle 32 interjected after every set of several double wedge mixing baffle 12 in the series.

The total number of double wedge mixing baffles 12, entry mixing elements 30, and flow inverter baffles 32 may vary in different embodiments of the static mixer 10. Thus, although the particular structure of the flow inverter baffle 32 shown in FIG. 1 will be described in considerable detail below, the static mixer 10 is merely one example of an embodiment incorporating aspects of the present disclosure. It will be understood that one or more of the elements defining the mixing component 20 may be reorganized or modified from those shown without departing from the scope of this disclosure (so long at least one of the elements in the mixing component 20 is a flow inverter baffle 32, 210, 310 according to one of the various embodiments). As shown, the series of mixing elements and/or baffles defining the mixing component 20 are integrally molded with one another so as to define first and second sidewalls 34, 36. The first and second sidewalls 34, 36 at least partially bound opposite sides of the mixing component 20, whereas the other sides of the mixing component 20 extending between the first and second sidewalls 34, 36 remain largely open or exposed to an associated interior surface 38 of the mixer conduit 14. As shown in the cut away, the interior 38 includes first and second interior surfaces 39, 41 corresponding to the left and right sides, respectively.

Figure 2:
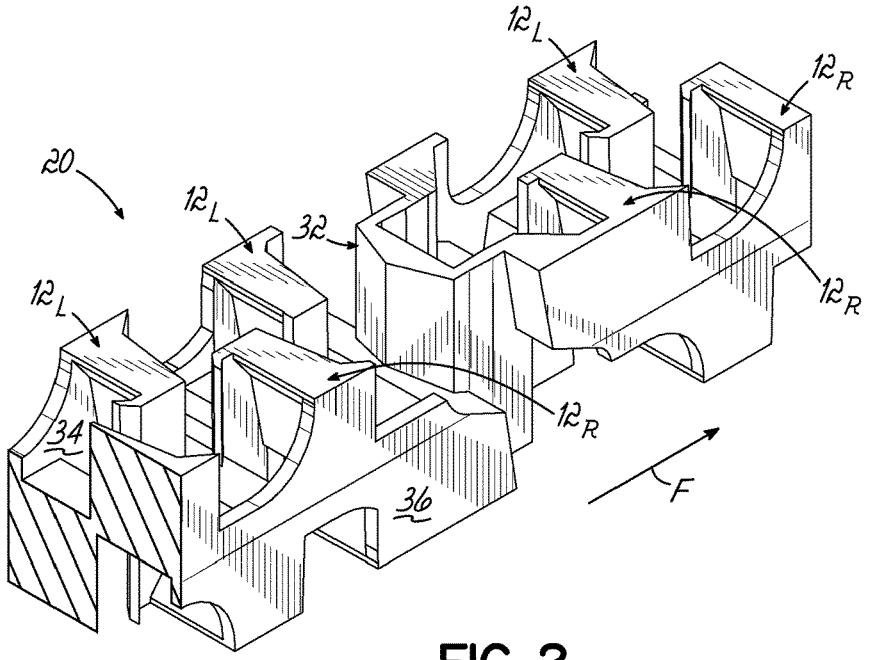
FIG. 2 is a perspective view of a partial portion of the mixing component of FIG. 1 removed from the remainder of the static mixer, the mixing component including a flow inverter baffle interjected between a series of alternating right-handed and left-handed double wedge mixing baffles.

Now referring to FIG. 2, partial portions of the mixing component 20 are shown in further detail separated from the remainder of the static mixer 10. For example, the specific profile of the first and second sidewalls 34, 36 defined by the opposing sides of the mixing component 20 is more clearly visible. The mixing component 20 include a series of double wedge mixing baffles 12, which specifically alternate between double wedge mixing baffles $\mathbf{12}_R$ having a first configuration (also called right-handed mixing baffles $\mathbf{12}_R$) and double wedge mixing baffles $\mathbf{12}_L$ having a second configuration (also called left-handed mixing baffles $\mathbf{12}_L$). The first and second configurations are similar, but reversed about at least one center plane aligned parallel to a longitudinal axis of the mixing component 20 and mixer conduit 14 such that the double wedge mixing baffles $\mathbf{12}_R$ and $\mathbf{12}_L$ are mirror images of each other. This different notation or labeling applied to the two types of double wedge mixing baffles 12 results from the different "rotational" movements that the fluid flow experiences when moving through these mixing baffles 12 (e.g., generally clockwise or generally counterclockwise). Each of the double wedge mixing baffles 12 divides a fluid flow through a mixer conduit 14 at a mixing baffle leading edge 16 of the mixing baffle 12 and then shifts or rotates that flow clockwise or counterclockwise through a partial rotation before recombining the fluid flow at a mixing baffle trailing edge 18. The portion of the mixing component 20 shown in FIG. 2 begins with a partial right-handed mixing baffle $12_R$, a left-handed mixing baffle $12_L$, right-handed mixing baffle $12_R$, and then includes, in sequence: a left-handed mixing baffle $12_L$, the flow inverter baffle 32, followed by additional double wedge mixing baffles 12.

Figure 3:
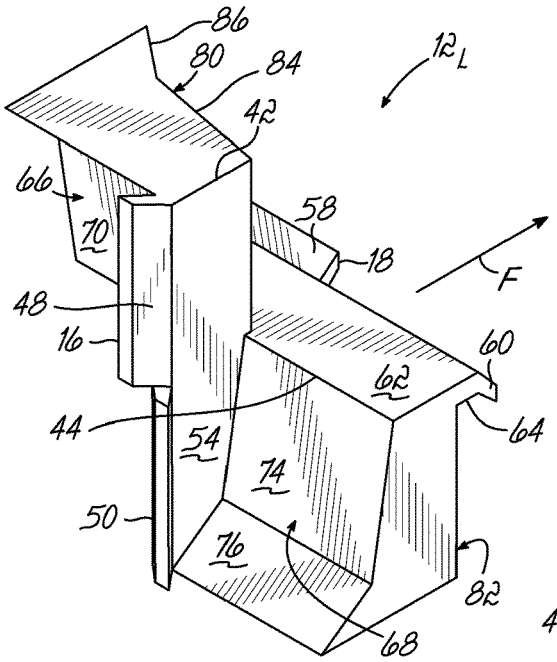
FIG. 3 is a perspective view of one of the left-handed double wedge mixing baffles of FIG. 2, separated from the other elements to reveal specific structural elements.

Similar to known Multiflux mixing elements, the double wedge mixing baffles 12 include a plurality of deflecting surfaces, which are numbered in FIGS. 3 and 4, and summarily described below. It will be understood that a more thorough description is provided in U.S. patent application Ser. No. 14/620,227, incorporated by reference above. FIG. 3 shows the left-handed mixing baffle $12_L$ as including first and second mixing dividing panels 42, 44. Various hook sections 48, 50, 58 and 60 help guide the divided fluid flow (moving along the direction of arrow F in each drawing view) into the opposite sides of the mixing baffle dividing panels 42, 44 while avoiding a division of flow along a long transverse edge which could cause undesirable high amounts of backpressure in the static mixer 10. The left-handed mixing baffle $12_L$ includes first and second deflecting surfaces 66, 68 extending outwardly in opposite directions from the first mixing baffle dividing panel 42 towards the first and second sidewalls 34, 36 (when assembled with the remainder of the mixing component 20). Advantageously, each of the first and second deflecting surfaces 66, 68 includes multiple planar surfaces (also referred to as "wedge surfaces") oriented at different angles relative to the fluid flow through the mixing baffle $12_L$. The arrangement of two planar surfaces 70, 72, 74, and 76 on each of the first and second deflecting surfaces 66, 68 enables the left-handed mixing baffle $12_L$ to provide optimized mixing and reduced waste volume retention compared to conventional mixing baffle designs having only a single planar surface or rounded surfaces. As described above, the first planar surfaces 70, 74, 84 and 88 are oriented at a different angle to the flow than the second planar surfaces 72, 76, 86 and 90. The first and second planar surfaces collectively define a double wedge shape for the deflecting surfaces 66, 68, 80 and 82.

Figure 4:
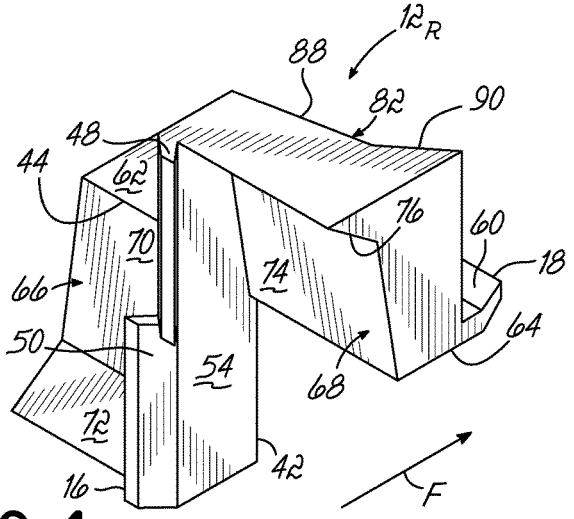
FIG. 4 is a perspective view of one of the right-handed double wedge mixing baffles of FIG. 2, separated from the other elements to reveal specific structural elements.

FIG. 4 shows a right-handed mixing baffle $12_R$ with essentially the same identical structure as the left-handed mixing baffle $12_L$ described above with respect to FIG. 3, but just with the deflecting surfaces 66, 68, 80, 82 being oriented to be a mirror image of those in the left-handed mixing baffle $12_L$. The panels and surfaces of the right-handed mixing baffle $12_R$ are substantially identical in structure and function to the corresponding panels and surfaces described above, so these elements have been labeled with the same reference numbers on both types of mixing baffles 12, $12_L$, $12_R$. The left-handed mixing baffles $12_L$ shift fluid flow in a generally counterclockwise direction, while the right-handed mixing baffles $12_R$ shift flow in a generally clockwise direction. It will be appreciated that the orientation-based labels such as vertical, horizontal, left, right, top and bottom as used in reference to surfaces or sides, refers to the orientation of these elements as shown in the FIGS., but alternative orientations of these elements within the mixer conduit 14 may be used in actual practice or other embodiments within the scope of this disclosure. To this end, the various sides 54, 62 and 64 of the first and second mixing baffle dividing panels 42, 44 may be referred to as "first" and "second" sides as well, such as in the summary provided above.

Figure 5:
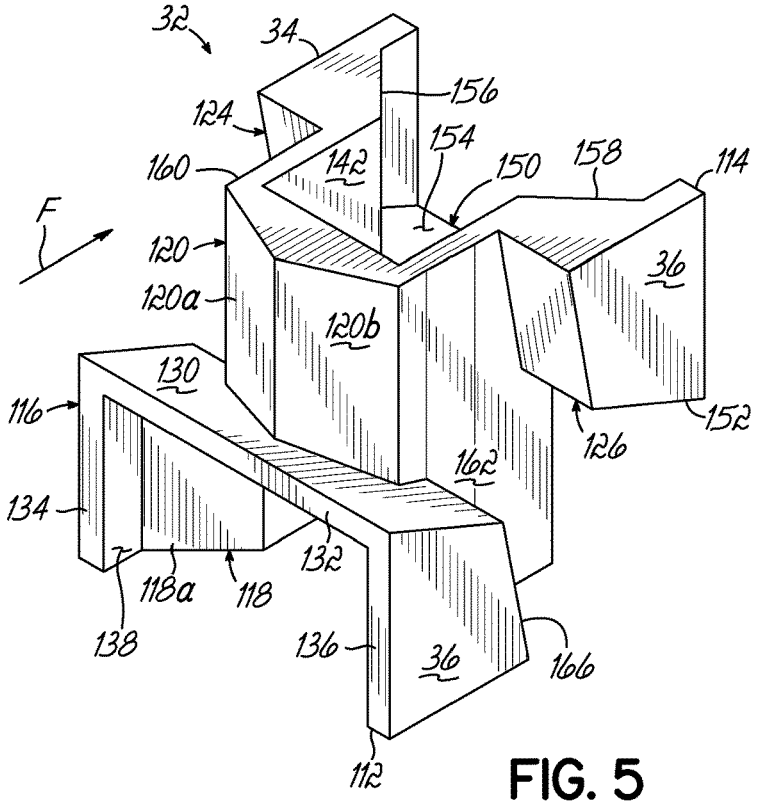
FIG. 5 is a front perspective view of the flow inverter baffle of FIG. 2, separated from the other elements to reveal specific structural elements.

FIG. 5 shows a flow inverter baffle 32 according to one embodiment of the present invention. The flow inverter baffle 32 defines a transverse flow cross-section perpendicular to the fluid flow F along an entire length between the leading edge 112 and the trailing edge 114. The flow inverter baffle 32 includes a first dividing panel 116, one or more compressing elements 118, a dividing element 120, and first, second and third inversion elements 122, 124, 126. Each of these structures will be discussed in detail below in relation to the following figures.

Figure 7:
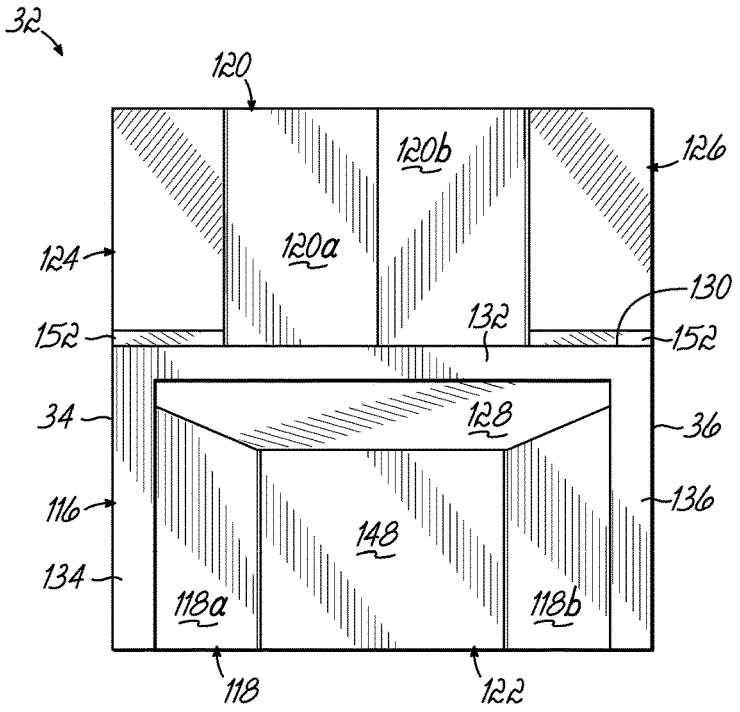
FIG. 7 is a front elevational view of the flow inverter baffle of FIG. 5.

With continued reference to FIG. 5, the first dividing panel 116 is located adjacent to the leading edge 112 and has a first side 128 (shown in FIG. 7) and a second side 130. The first dividing panel 116 divides the fluid flow F into a first flow portion the flows adjacent to the first side 128 of the first dividing panel 116 and a second flow portion the flows adjacent to the second side 130. Specifically as shown, the first flow portion is the lower flow portion that flows under the first side 128 of the first dividing panel 116, while the second flow portion is the upper flow portion that flows above the second side 130. As shown in FIG. 7 with respect to the first side 128, and FIGS. 5 and 8 with respect to the second side 130, the first and second sides 128, 130 are angled downwardly away from the leading edge 112 and toward the trailing edge 114. The first dividing panel 116 includes a generally horizontal wall 132 and first and second support walls 134, 136. The first and second support walls 134, 136 include interior surfaces 138 with the exterior surfaces being defined by the first and second sidewalls 34, 36. Those skilled in the art would appreciate that the first dividing panel 116 may be integrally formed as a unitary piece with the static mixer 10, resulting in one or both of the first and second support walls 134, 136 potentially being omitted.

After the first flow portion passes the first dividing panel 116, the first flow portion may be compressed using one or more compressing elements 118. As shown in the front perspective view of FIG. 5, and more clearly through the front plan view of FIG. 7, the one or more compressing elements 118 include first and second oppositely angled surfaces 118*a*, 118*b*. Further as shown in FIG. 7, the first side 128 of the first dividing panel 116 is angled downwards in the direction of the fluid flow F to aid in the compression. The first and second oppositely angled surfaces 118*a*, 118*b* combine with the angled first side 128 of the first dividing panel 116 to collectively form a funnel-shape to compress the first flow portion towards the horizontal lower center of the transverse flow cross-section. While not shown in this embodiment, those skilled in the art would appreciate that the one or more compressing elements 118 may be arcuate and/or include more or fewer surfaces, if desired.

Figure 6:
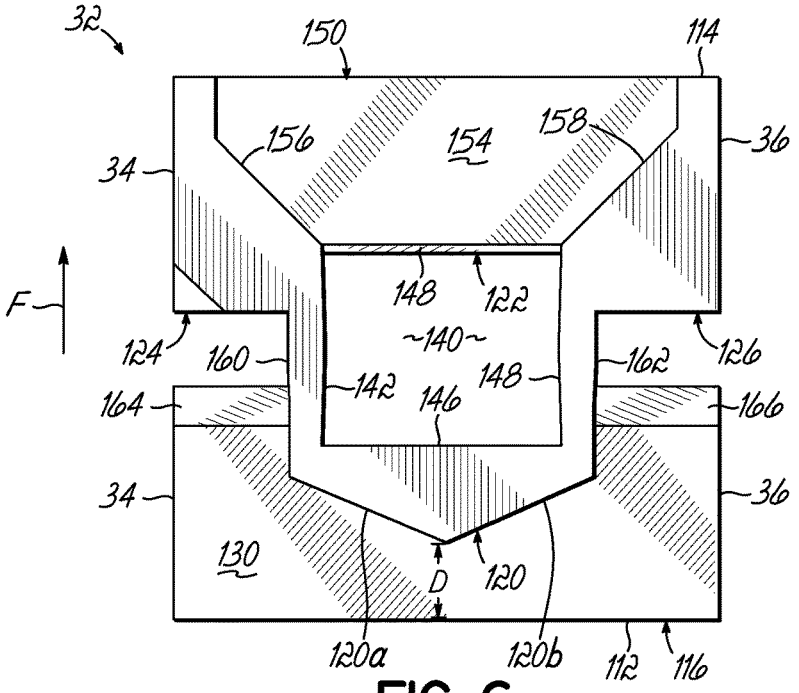
FIG. 6 is a top view of the flow inverter baffle of FIG. 5.

FIGS. 6 and 7 show that after the first flow portion is compressed using the first and second oppositely angled surfaces 118*a*, 118*b*, the first flow portion enters a central passageway 140. As shown in the top view of FIG. 6, the central passageway 140 extends vertically in a direction parallel to the transverse flow cross-section. The central passageway 140 is defined in part by first and second oppositely disposed passageway surfaces 142, 144 (on the left and right with reference to FIG. 6) that extend in a direction generally parallel to the fluid flow F. The central passageway 140 is further delimited on an upstream side thereof by a leading passageway surface 146 located adjacent to the first dividing panel 116 and extending vertically in a direction generally parallel to the transverse flow cross-section. The central passageway 140 is additionally defined by the first inversion element 122 as will be described in greater detail below.

The first inversion element 122 shifts the first flow portion to a different location with respect to the transverse flow cross-section. Specifically as shown in FIGS. 6 and 7, the first inversion element 122 causes the first flow portion to flow upwardly in the central passageway 140. The first inversion element 122 is located downstream (with reference to the fluid flow F) of the one or more compressing elements 118 at a downstream end of the central passageway 140, and includes an occluding wall 148, located generally parallel with respect to the transverse flow cross-section (e.g., generally perpendicular to the fluid flow direction F). The occluding wall 148 shifts the first flow portion upwardly to a location adjacent a second dividing panel 150.

As shown in FIG. 6, the second dividing panel 150 is located downstream of the central passageway 140 and the first inversion element 122 and forms a portion of the trailing edge 114. The second dividing panel 150 has a first side 152 and a second side 154 to separate the first flow portion from the second flow portion. The first flow portion expands along the second side 154 of the second dividing panel 150 as a result of flow along the first and second oppositely angled expanding surfaces 156, 158, which collectively define a reverse funnel shape opening towards the trailing edge 114. Now that the progression of the first flow portion has been described with reference to FIGS. 5 through 8, the progression of the second flow portion through the flow inverter baffle 32 will now be described.

As shown in FIGS. 5 through 7, after the first dividing panel 116 divides the first flow portion from the second flow portion, the second flow portion is again divided into first and second perimeter flow portions using the dividing element 120. With reference to FIG. 6, the dividing element 120 is located adjacent the second side 130 of the first dividing panel 116 and at a distance D away from the leading edge 112. However, the dividing element 120 may be placed at the leading edge 112 if desired. In this embodiment, the dividing element 120 includes first and second outwardly extending generally planar surfaces 120*a*, 120*b* to separate and shift the first and second perimeter flow portions, which is also an arrangement distinctive from the alternative embodiment shown in FIG. 14 and described below. The first outwardly extending generally planar surface 120*a* directs the first perimeter flow portion to the left, adjacent the first interior surface 39 of the interior 38, while the second outwardly extending generally planar surface 120*b* directs the second perimeter flow portion to the right, adjacent the second interior surface 41 of the interior 38. As such, the first perimeter flow portion begins as the upper left flow portion, and second perimeter flow portion begins as the upper right flow portion.

In this embodiment, and as shown most clearly in FIGS. 6 and 7, the dividing element 120 is centered horizontally with respect to the transverse flow cross-section. Horizontally centering the dividing element 120 allows the second flow portion to be divided equally between the first and second perimeter flow portions. While not shown, those skilled in the art would appreciate that the dividing element 120 may be horizontally off-center with respect to the transverse flow cross-section, which may cause the first and second perimeter sections to not have equal flow/volume distribution.

Once the first and second perimeter flow portions are shifted using the dividing element 120, the first and second perimeter flow portions are inverted downwards using second and third inversion elements 124, 126. As shown most clearly in FIG. 7, the second inversion element 124 is located in the upper left quadrant and adjacent the first sidewall 34. The second inversion element 124 shifts the first perimeter flow portion downwards between the first interior surface 39 and the left side 160 of the second dividing panel 150. In a similar manner, the third inversion element 126 is located in the upper right quadrant and adjacent the second sidewall 36. The third inversion element 126 shifts the second perimeter flow portion downwards between the second interior surface 41 of the interior 38 and the right side 162 of the second dividing panel 150.

Figure 8:
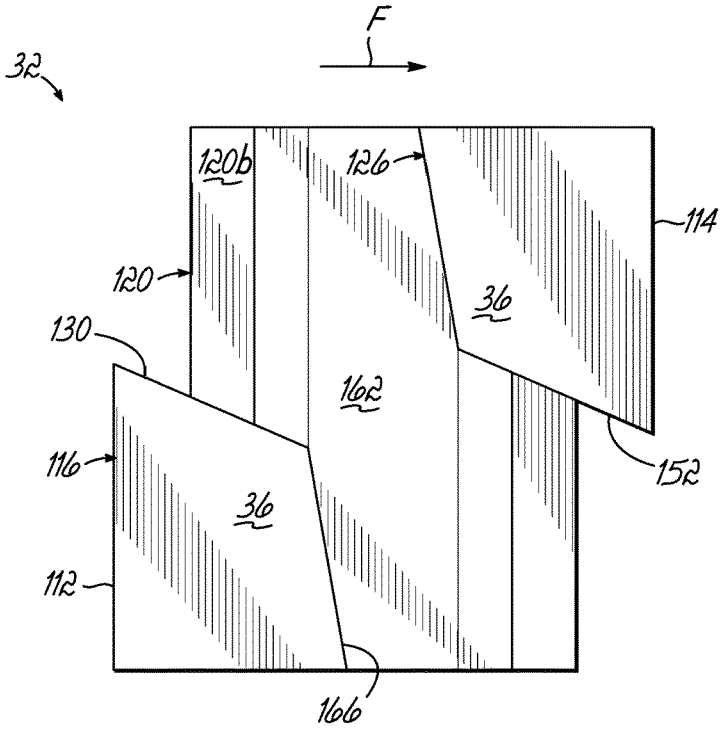
FIG. 8 is a left side elevational view of the flow inverter baffle of FIG. 5.

After being shifted, the first and second perimeter flow portions are recombined along the first side 152 of the second dividing panel 150 prior to reaching the trailing edge 114 of the flow inverter baffle 32, while the first flow portion remains separate from the first and second perimeter flow portions prior to reaching the trailing edge 114. As shown in FIG. 8, the first side 152 is angled downwardly and is generally parallel to the downward angle of the second side 130 of the first dividing panel 116 to assist in further shifting the second flow portion downwards. The first dividing panel 116 may also include first and second downwardly angled surfaces 164, 166 to help guide the first and second perimeter flow portions during inversion or shifting by the second and third inversion elements 124, 126, as will be further described below.

As shown in the various Figures described herein, the series of mixing baffles 12 and flow inverter baffles 32 are molded together in series in one preferred embodiment to form a unitary version of the mixing component 20, which includes the first and second sidewalls 34, 36. Similarly, the plurality of mixing baffles 12, and the at least one flow inverter baffle 32, 210, 310, may be formed integrally and/or be formed by injection molding. Specifically, the first and second sidewalls 34, 36 may be integrally formed with the plurality of mixing baffles 12 and the at least one flow inverter baffle 32. With respect to the flow inverter baffle 32, the first and second dividing panels 116, 150, the one or more compressing elements 118, the dividing element 120, and the first, second and third inversion elements 122, 124, 126 are integrally formed as a unitary piece and/or are injection molded as a unitary piece, but this applies equally to the flow inverter baffle 210 and 310 of other embodiments described below. However, one skilled in the art would appreciate that these mixing baffles 12 (and the other mixing elements interspersed in the series of the mixing component 20) may be separately formed and coupled together in the desired order after manufacturing, in other embodiments. Likewise, the mixing component 20 can optionally be formed integrally as a unitary piece with the mixer 10 in other embodiments.

Figure 9A:
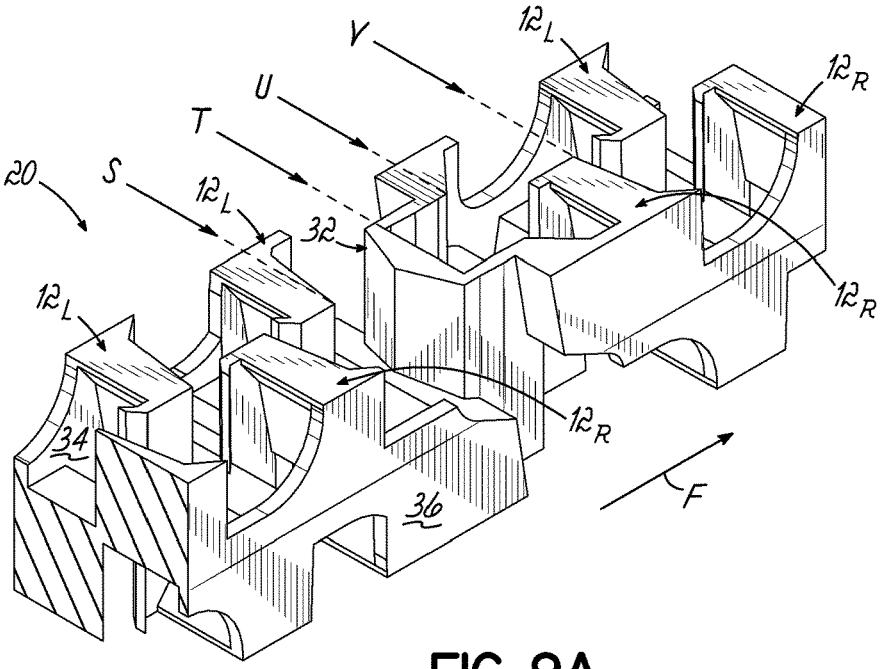
FIG. 9A is a front perspective view of a stack of mixing baffle elements including the flow inverter baffle of FIG. 5, with a series of flow cross-sections indicated.
Figure 9B:
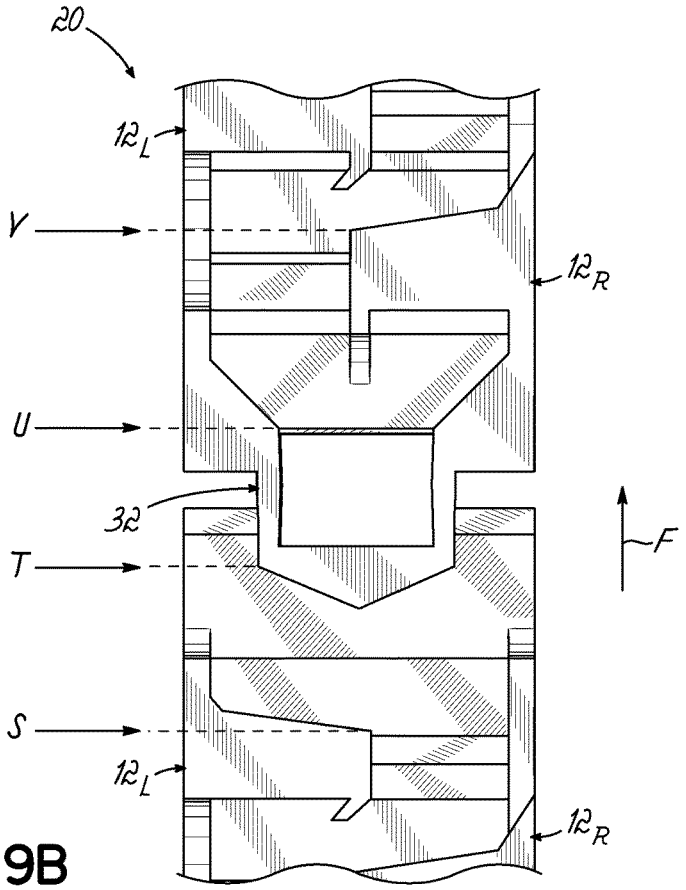
FIG. 9B is a top view of the partial portion of the mixing component of FIG. 9A, with the same series of flow cross-sections indicated.
Figure 9C:
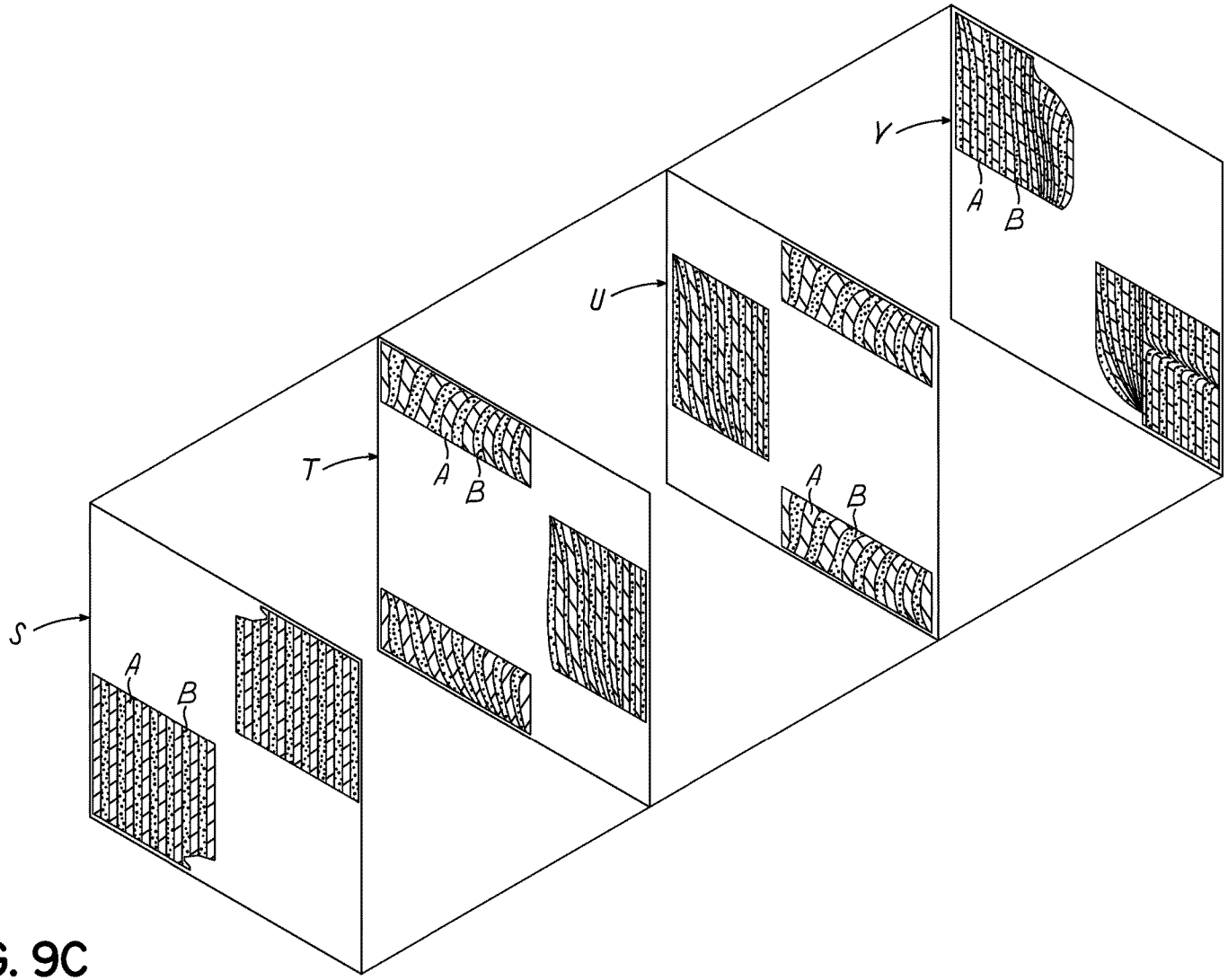
FIG. 9C is a schematic view of the fluid flow cross-sections of the flow inverter baffle of FIGS. 9A and 9B.

FIGS. 9A and 9B show the mixing component 20 with flow inverter baffle 32, indicating several relative locations where four flow cross-sections S, T, U, and V of FIG. 9C are respectively taken. FIG. 9C schematically shows a series of four flow cross-sections taken for a sample fluid flow having two components separated into a plurality of flow layers as evidenced by testing of the flow inverter baffle 32 of this embodiment and its associated static mixer 10. The specific locations of the flow cross-sections relative to the flow inverter baffle 32 and the mixing baffles 12 located immediately upstream and downstream from the flow inverter baffle 310 are indicated for clarity in FIGS. 9A and 9B. Each of the flow cross-sections S, T, U and V will now be discussed in turn, to help further explain the operation and benefits of the flow inverter baffle 32.

With reference to the flow cross-section S of FIG. 9C, the fluid is shown being shifted into two quadrants of the static mixer 10 by the double wedge mixing baffle $\mathbf{12}_L$ located immediately upstream (in the fluid flow direction) from the flow inverter baffle 32. The fluid flow F is defined by a number of layers of the two types of fluid, shown schematically by the different shading (A) or dotting (B). Each of the layers of A and B appear generally vertical in orientation. It will be understood that the two quadrants of fluid flow then spread to fill an entirety of the flow cross-section before encountering the leading edge 112. Next, flow cross-section T shown in FIG. 9C is taken after the fluid flow is divided into the first portion, and the first and second perimeter portions (the second lower portion) using first dividing panel 116. The first flow portion flows along a first side 128 of the first dividing panel 116 and the second flow portion flows along a second side 130 of the first dividing panel 116. Once again, the flow layers (A) and (B) continue to be substantially vertical in orientation.

Now with reference to the flow cross-section U of FIG. 9C, the fluid is shown after inverting the first flow portion upwardly using the first inversion element 122, located adjacent the second side 130 of the first dividing panel 116. Similarly, the first perimeter flow portion is already inverted downwardly using the second inversion element 124 located in an upper left quadrant, while the second perimeter flow portion is already inverted downwardly using the third inversion element 126 located in an upper right quadrant. Once again, the flow layers (A) and (B) appear substantially vertical in orientation. As a result of flow through the at least one flow inverter baffle 32, the flow layers of the at least two components are inverted, such as by shifting to a different portion of the flow cross-section, while maintaining a general vertical orientation of the flow layers A and B. The first shift of this resulting flow by the downstream mixing baffle $\mathbf{12}_R$ into two quadrants is shown in the flow cross-section V shown in FIG. 9C, which is an analogous state to the original one shown flow cross-section S of FIG. 9C before entering the flow inverter baffle 32. However, the further mixing effects caused by the inversion at flow inverter baffle 32 are evidenced when comparing the flows at FIGS. 9A and 9D.

Maintaining of the general orientation of the flow layers can be readily understood from a comparison of the various cross-sections of FIG. 9C. The flow inverter baffles according to the various embodiments generate less overall movement to perform an inversion of the flow as compared to prior art flow inverter baffles, which means the flow disturbances are less restrictive. Additionally, the flow inverter baffle 32 shuffles the fluid flow with less backpressure as compared to prior art flow inversion baffles, as a result of the limited overall flow movement. This backpressure reduction is also supplemented since after flow inverter baffle 32 inverts the first flow portion, the flow inverter baffle 32 replaces that evacuated space with the second flow portion (divided into the first and second perimeter flow portions). Likewise, after the flow inverter baffle 32 inverts the first and second perimeter flow portions, the flow inverter baffle 32 replaces the evacuated space with the first flow portion. As a result, the flow is more evenly distributed without disturbing the general orientation of the fluid layering. Avoiding layer jumbling minimizes the risk of the flow inverter baffle 32 generating flow streaks which require further mixing.

Figure 9D:
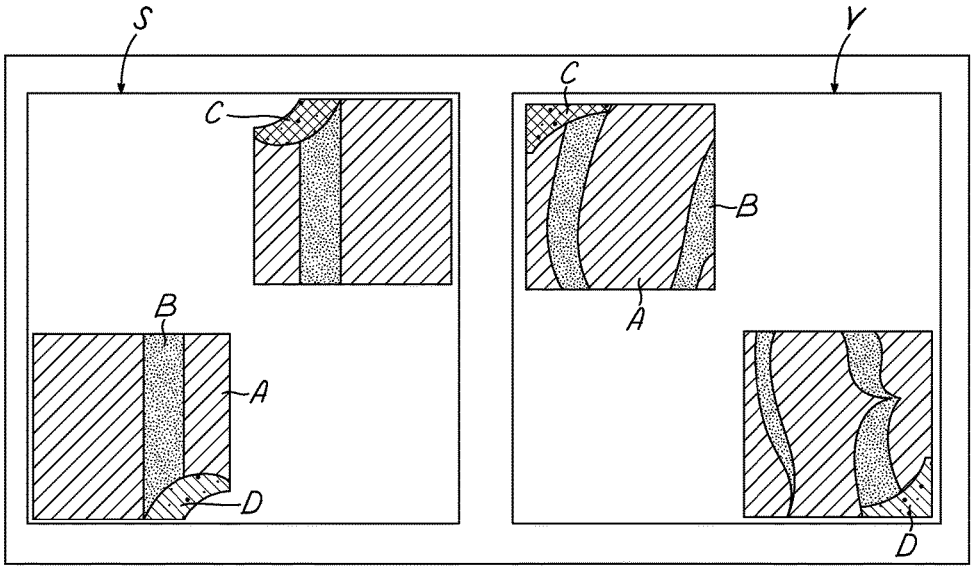
FIG. 9D shows a progression of how the flow inverter baffle moves a streak region from the inside of the fluid flow to the outside of the fluid flow.

The flow inverter baffle 32 is also advantageously operable to shift any flow streaks to a different part of the flow cross-section. FIG. 9D shows the relative locations of a first fluid streak (C) and a second fluid streak (D) prior to entering (left) and after exiting (right) the flow inverter baffle 32. Specifically, the left flow cross-section shows the relative positions of the first and second fluid streaks prior to entering the flow inverter baffle 32, which corresponds to cross-section S of FIG. 9C. The right flow cross-section shows the relative positions of the first and second fluid streaks after exiting the flow inverter baffle 32, which corresponds to cross-section V of FIG. 9C. As shown by comparing the flow cross-sections of FIG. 9D, the flow inverter baffle 32 moves the first fluid streak and the second fluid streak from a central portion of the transverse flow cross-section to the outer periphery. This shifting of position allows downstream mixing baffles 12 or elements to more effectively eliminate the fluid streaks, thereby improving the efficiency of the static mixer 10 without distorting the fluid layers. Additionally, the layers stay generally parallel (shown as generally vertical) because there is less movement or other rotation around corners of the flow inverter baffle 32, as compared to prior art flow inverter baffles.

Figure 10A:
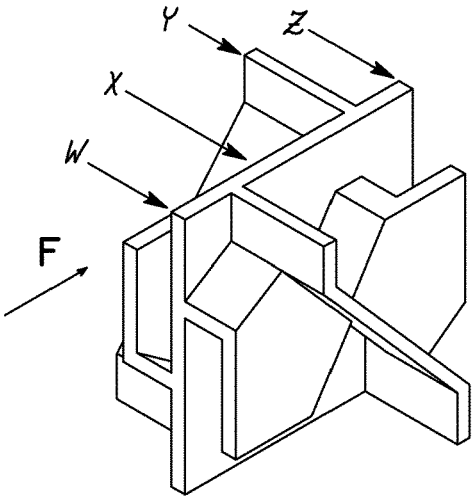
FIG. 10A PRIOR ART
FIG. 10A is a front perspective view of a prior art flow inverter baffle, with various flow cross-sections indicated.
Figure 10B:
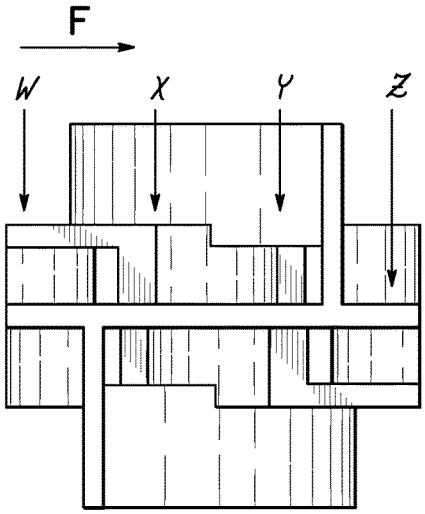
FIG. 10B PRIOR ART
FIG. 10B is a top view of the prior art flow inverter baffle of FIG. 10A, with the same cross-sections indicated.
Figure 10C:
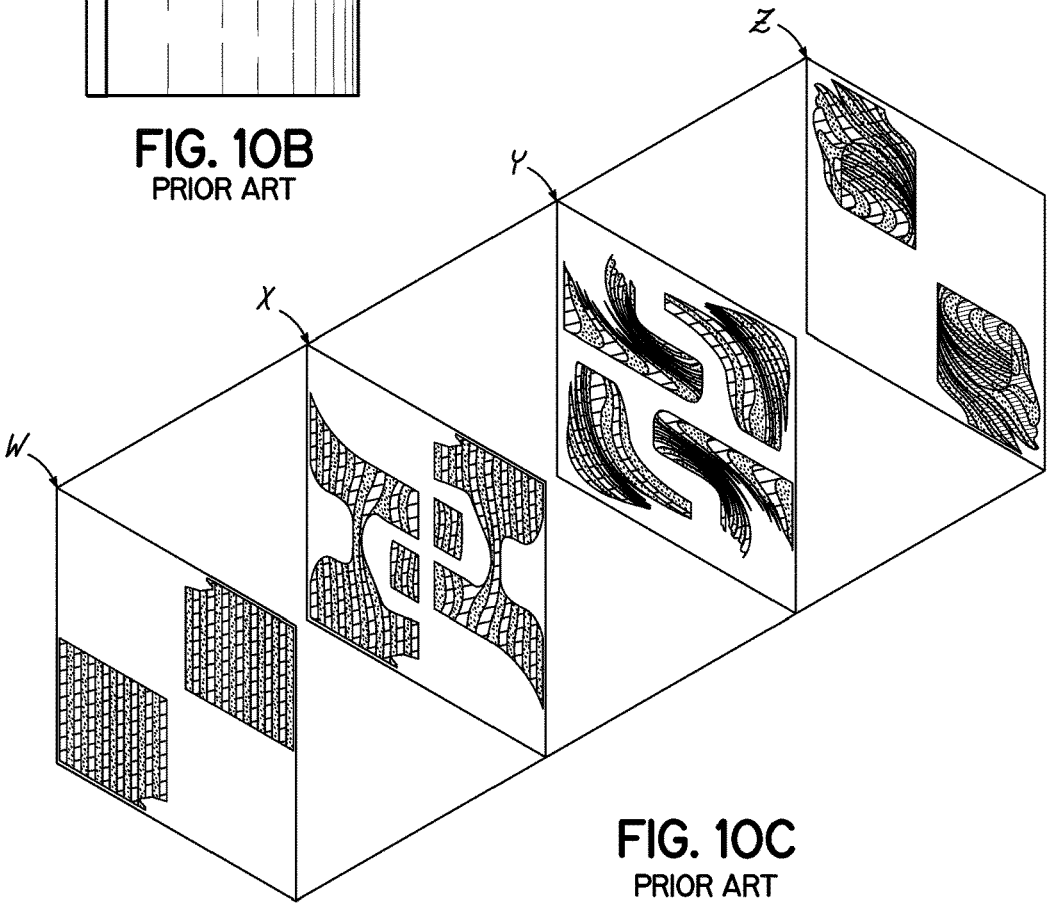
FIG. 10C PRIOR ART
FIG. 10C is a schematic view of the fluid flow cross-sections of the prior art flow inverter baffle of FIGS. 10A and 10B.

FIGS. 10A and 10B respectively show a front perspective view and a top view of a prior art flow inverter baffle as shown and described in U.S. Pat. No. 7,985,020 to Pappalardo, as previously referenced in the background section. FIGS. 10A and 10B each include reference cross-sections W, X, Y and Z from which the flow cross-sections of FIG. 100 are taken. As such, FIG. 100 is a schematic view of the fluid flow cross-sections of the prior art flow inverter baffle of FIGS. 10A and 10B. It can readily be seen in these flow cross-sections that the flow layers are more jumbled and forced through more overall movement to invert the flow in this prior art baffle, which are improved upon in the current designs.

Figure 11B:
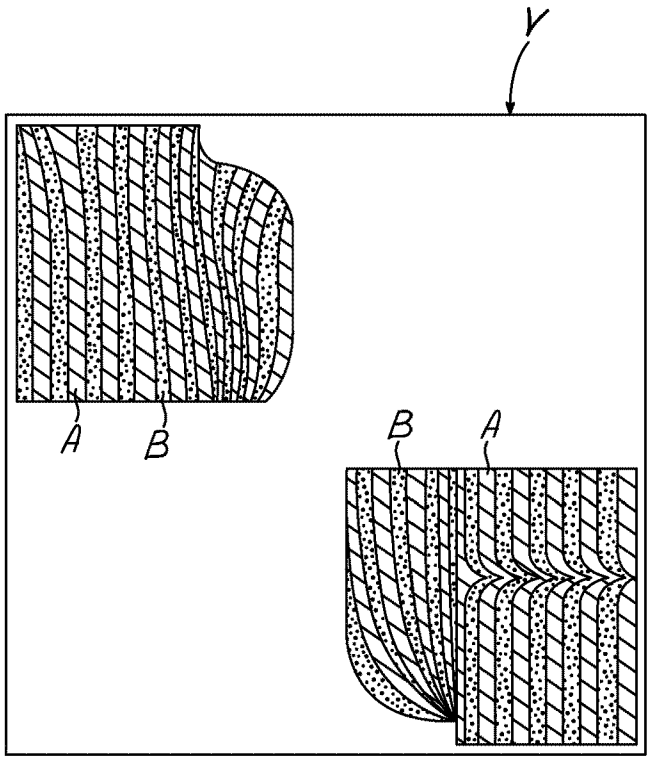
FIG. 11B a schematic view showing fluid flow cross-sections after flowing through some of the mixing baffle elements, including one of the flow inverter baffles of FIGS. 5 through 9C.
Figure 11A:
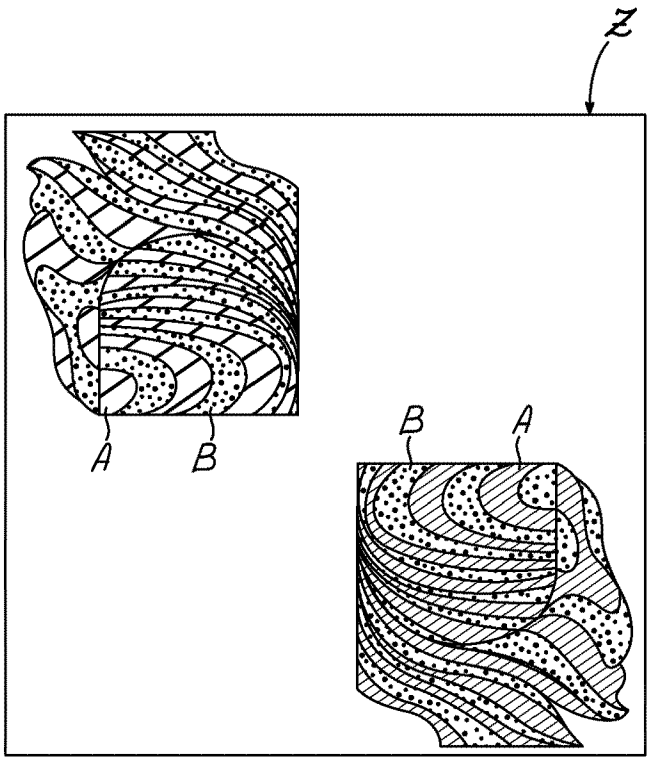
FIG. 11A PRIOR ART
FIG. 11A is a schematic view showing fluid flow cross-sections after flowing through some of the mixing baffle elements of the prior art static mixer, including the flow inverter baffle of FIGS. 10A and 10B.

FIGS. 11A and 11B respectively show the side-by-side mixing results using a conventional static mixer (including one or more flow inverter baffles such as those shown in FIGS. 10A and 10B) and the static mixer 10 according to an aspect of the present invention. Specifically, FIG. 11B illustrates the mixing result (e.g., at flow cross-section V of FIG. 9C) achieved by the series of mixing baffles or elements in accordance with the embodiments of the static mixer 10 having the flow inverter baffle 32. As can be seen, the flow layers of components A and B are thoroughly mixed and the flow layers are substantially maintained in orientation to ensure the high efficiency of this mixing action (e.g., no additional flow streaks are produced by jumbling together of the flow layers). As compared to the flow result of the prior art static mixer of FIG. 11A (e.g., at flow cross-section Z of FIG. 100), the static mixer 10 of FIG. 11B appears to cause less jumbling of the layers, as the layers of components A and B in FIG. 11B are generally parallel to one another resulting in greater mixing with no added flow streaks of completely unmixed fluid in the extruded mixture. Thus, the static mixer 10 achieves various functional benefits over conventional mixer and inverter designs as set forth in detail above.

Figure 12:
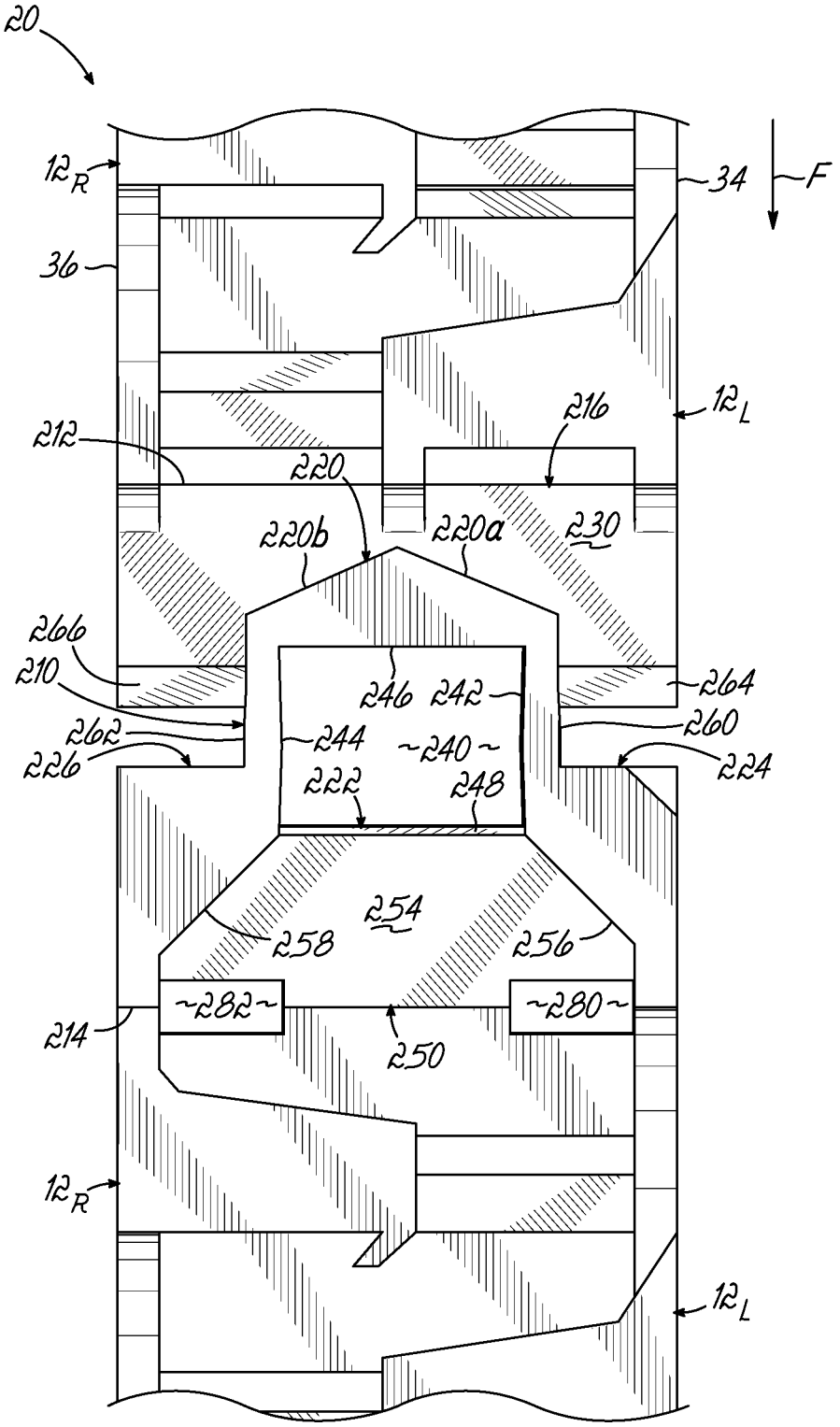
FIG. 12 is a top view of the partial portion of a mixing component containing a flow inverter baffle having windows according to another embodiment of the invention.
Figure 13:
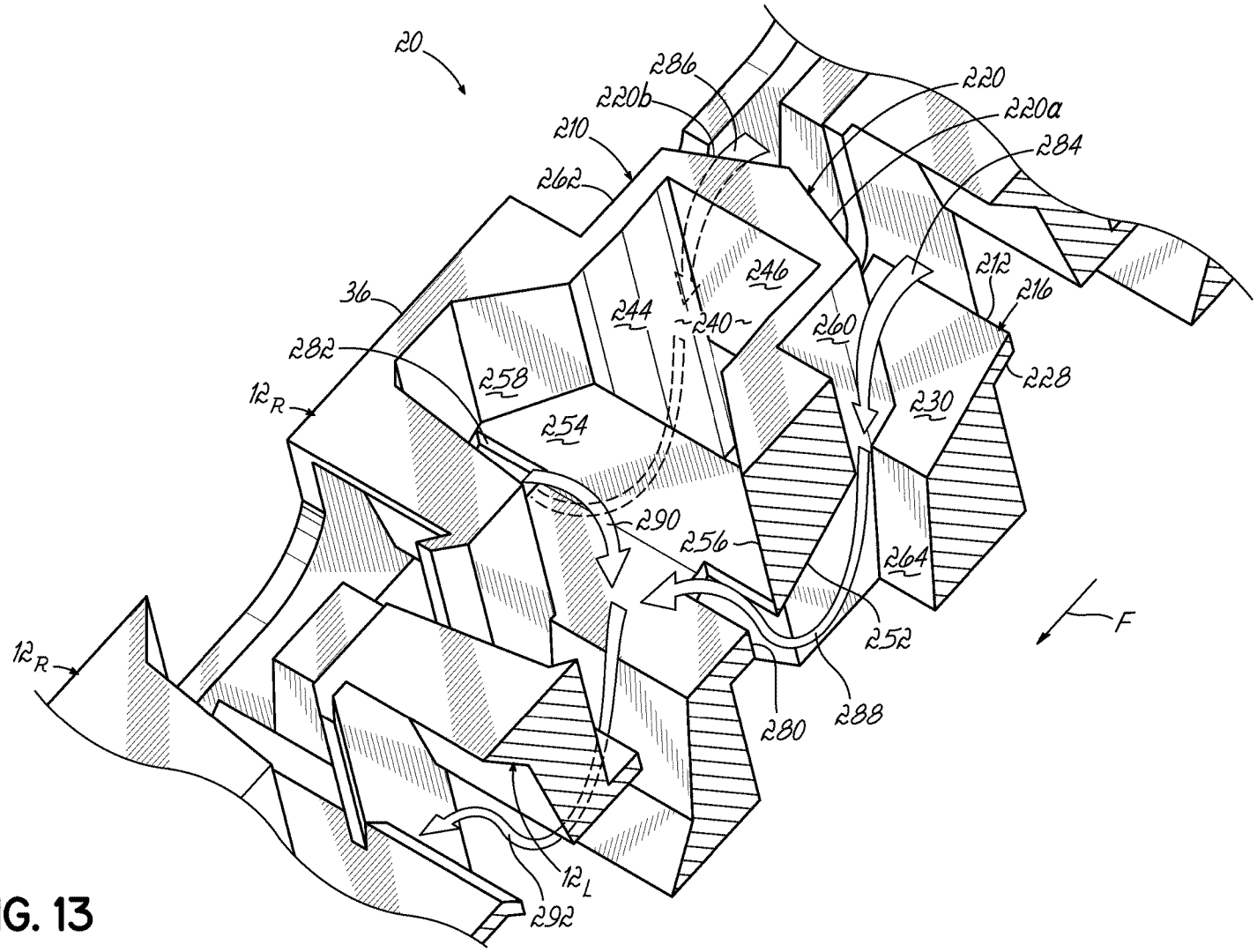
FIG. 13 is a front perspective view of the partial portion of the mixing component of FIG. 12 with the fluid flow schematically shown using a series of arrows.

With reference to FIGS. 12 and 13, another embodiment of a flow inverter baffle 210 in accordance with this invention is shown in detail. This flow inverter baffle 210 includes many of the same elements as the previously described embodiment of flow inverter baffle 32, and these elements have been provided with similar reference numbers in the 200 series where the shown elements are substantially similar or identical. For example, the flow inverter baffle 210 of this embodiment again includes a leading edge 212, a trailing edge 214, a first dividing panel 216 (with first and second sides 228, 230), a dividing element 220 (with first and second outwardly extending planar surfaces 220*a*, 220*b*), a first inversion element 222 (including an occluding surface 248), second and third inversion elements 224, 226, first and second oppositely opposed disposed passageway surfaces 242, 244, a central passageway 240, a leading passageway surface 246, a second dividing panel 250 (with the left side 260, the right side 262, and the second side 254 being shown), first and second oppositely opposed angled expanding surfaces 256, 258, and first and second downwardly angled surfaces 264, 266.

Although many of these elements have slightly modified shapes or profiles in this embodiment, the flow inverter baffle 210 and its elements function as described above except where the differences are outlined in further detail below (the detailed description of these identical or substantially similar elements is largely not repeated herein for the sake of brevity). Accordingly, it will be understood that the specific angles and relative sizes or lengths of the surface portions may be modified in other embodiments consistent with the scope of this disclosure. In this embodiment, the flow inverter baffle 210 includes windows 280, 282 located in the second dividing panel 250. The windows 280, 282 are configured to recombine the first and second perimeter flow portions of the second flow portion with the first flow portion. The windows 280, 282 also correct for any pressure differential developed during fluid by movement through the flow inverter baffle 32. While two windows 280, 282 are formed in the second dividing panel 250 of FIGS. 12 and 13, one skilled in the art would appreciate that any number of windows may be utilized and repositioned as necessary, and other structures such as spaces, voids or gaps may be used instead of or in addition to windows 280, 282.

With reference to FIG. 13, the movement of the first and second perimeter flow portions is shown using a series of arrows which will be described in greater detail below. Arrow 284 shows the progression of the first perimeter flow portion flowing adjacent the second side 230 of the first dividing panel 216 and the left side 260 of second dividing panel 250. Similarly, arrow 286 shows the progression of the second perimeter flow portion flowing adjacent the second side 230 of the first dividing panel 216 and the right side 262 of second dividing panel 250. Arrow 288 shows the first perimeter flow portion being inverted downwards with the second inversion element 224. As a result, the first perimeter flow portion flows between the left side 260 of second dividing panel 250 and the first interior surface 39 of the interior 38 and downwardly along the first downwardly angled surface 264 and the first side 252 of the second dividing panel 250. Arrow 288 terminates after being recombined upwardly near the trailing edge 214 of the flow inverter baffle 210. Similarly, arrow 290 shows the second perimeter flow portion being inverted downwards with the third inversion element 226. As a result, the second perimeter flow portion flows between the right side 262 of second dividing panel 250 and the second interior surface 41 of the interior 38 and downwardly along the second downwardly angled surface 266 and the first side 252 of the second dividing panel 250. The arrows 288, 290 at this portion also show flow through the windows 280, 282 to the second side 254 of the second dividing panel 250. The first and second flow portions are shown as being recombined near the trailing edge 214 of the flow inverter baffle 32. Arrow 292 shows the now recombined fluid flow being forced through left-handed mixing baffle $\mathbf{12}_L$.

Therefore, much like the previous embodiment, the flow inverter baffle 210 moves flow streaks away from a central portion of the static mixer 10 and to the outer periphery or vice versa while maintaining the general orientation of flow layers so that the layers are not jumbled or mixed together in a detrimental manner, while also minimizing the backpressure caused by flowing through the flow inverter baffle 210.

Figure 14:
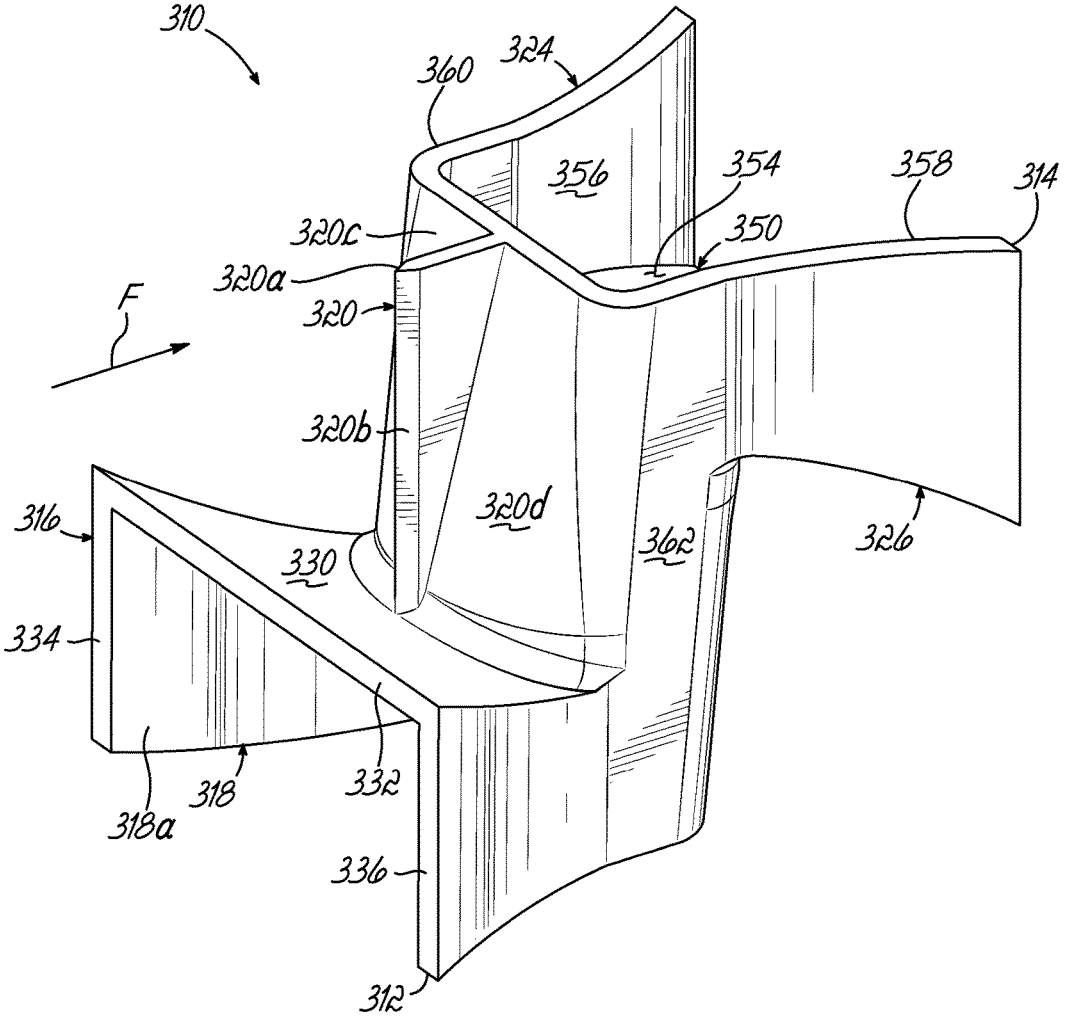
FIG. 14 is a front perspective view of the flow inverter baffle according to another embodiment of the invention.

With reference to FIG. 14, another embodiment of a flow inverter baffle 310 in accordance with this invention is shown in detail. This flow inverter baffle 310 includes many of the same elements as the previously described embodiments (flow inverter baffles 32, 210), and these elements have been provided with similar reference numbers in the 300 series where the elements are substantially similar or identical. For example, the flow inverter baffle 310 of this embodiment again includes a leading edge 312, a trailing edge 314, a first dividing panel 316 (with a second side 330 being shown), one or more compressing surfaces 318 (with a first oppositely angled surface 318*a* being shown), a dividing element 320 (with first and second outwardly extending planar surfaces 320*a*, 320*b* being shown), second inversion element 324, a third inversion element 326, a horizontal wall 332, a first support wall 334, a second support wall 336, a second dividing panel 350 (with a second side 354, a left side 360 and a right side 362 being shown), a first oppositely angled expanding surface 356, and a second oppositely angled expanding surface 358. Although many of these elements have slightly modified shapes or profiles in this embodiment, the flow inverter baffle 310 and its elements function as described above except where the differences are outlined in further detail below (the detailed description of these identical or substantially similar elements is largely not repeated herein for the sake of brevity).

FIG. 14 shows the flow inverter baffle 310 according to an alternative embodiment. This alternative embodiment is shown in the same orientation as the flow inverter baffle 32 shown in FIG. 5, to thereby clarify the distinctions between the embodiments. A first distinction with this embodiment is that the first dividing panel 316 is off-center vertically with respect to the transverse flow cross-section. As a result, the first flow portion (flowing below the horizontal wall 332 and between the first and second support walls 334, 336) is less than the second flow portion (flowing above the horizontal wall 332). A second distinction is that the first and second outwardly extending planar surfaces 320*a*, 320*b* initially divide the second flow portion into first and second perimeter flow portions, such that first and second arcuate surfaces 320*c* and 320*d* further divide and expand the first and second perimeter flow portions. The first and second arcuate surfaces 320*c*, 320*d* aid in directing flow to the outer periphery. One skilled in the art would appreciate that the first dividing panel 316 may include a tapered or sharpened end at the leading edge 312 to help reduce backpressure and/or aid in dividing the flow into first and second flow portions. Another distinction is that the first and second support walls 334, 336 extend inwardly to form the first and second oppositely angled surfaces 118*a*, 118*b*.

Therefore, much like the previous embodiment, the flow inverter baffle 310 moves any flow streaks away from a central portion towards an outer periphery of the static mixer 10 or vice versa while also maintaining the general orientation of flow layers so that the layers are not jumbled or mixed together in a detrimental manner, and also with minimized additional backpressure caused by flow through the flow inverter baffle 310.

While the present invention has been illustrated by a description of exemplary embodiments and while these embodiments have been described in some detail, it is not the intention of the Applicant to restrict or in any way limit the scope of the appended claims to such detail. Additional advantages and modifications will readily appear to those skilled in the art. The various features of the disclosure may be used alone or in any combination depending on the needs and preferences of the user. This has been a description of the present invention, along with the preferred methods of practicing the present invention as currently known. However, the invention itself should only be defined by the appended claims.

What is claimed is:

1. A flow inverter baffle for mixing a fluid flow having at least two components, the flow inverter baffle comprising:

a leading edge and a trailing edge, the flow inverter baffle defining a transverse flow cross-section perpendicular to the fluid flow along an entire length between the leading and trailing edges;

a first dividing panel adjacent to the leading edge and having first and second sides, the first dividing panel configured to divide the fluid flow into a first flow portion adjacent the first side of the first dividing panel and a second flow portion adjacent the second side of the first dividing panel;

one or more compressing elements configured to compress the first flow portion;

a first inversion element located downstream of the one or more compressing elements and configured to shift the first flow portion to a different location with respect to the transverse flow cross-section;

a dividing element located adjacent the second side of the first dividing panel and configured to divide the second flow portion into first and second perimeter flow portions;

a second inversion element configured to shift the first perimeter flow portion;

a third inversion element configured to shift the second perimeter flow portion; and a central passageway extending through the flow inverter baffle parallel to the transverse flow cross-section and between the second and third inversion elements along a direction substantially perpendicular to the fluid flow.

2. The flow inverter baffle of claim 1, wherein:

the first flow portion is a lower flow portion, such that the first inversion element is configured to shift an entirety of the first flow portion upwardly with respect to the transverse flow cross-section, the first perimeter flow portion is an upper left flow portion, such that the second inversion element is configured to shift the upper left flow portion downwardly with respect to the transverse flow cross-section, and the second perimeter flow portion is an upper right flow portion, such that the third inversion element is configured to shift the upper right flow portion downwardly with respect to the transverse flow cross-section.

3. The flow inverter baffle of claim 1, further comprising:

a second dividing panel located adjacent to the trailing edge and configured to separate the first flow portion from the first and second perimeter flow portions.

4. The flow inverter baffle of claim 3, wherein:

the first inversion element includes an occluding wall generally parallel with respect to the transverse flow cross-section and is configured to shift the first flow portion upwardly with respect to the transverse flow cross-section and adjacent the first side of the second dividing panel, the second inversion element is located in an upper left quadrant and is configured to shift the first perimeter flow portion downwardly with respect to the transverse flow cross-section and then along a left side of the second dividing panel, and the third inversion element is located in an upper right quadrant and is configured to shift the second perimeter flow portion downwardly with respect to the transverse flow cross-section and then along a right side of the second dividing panel.

5. The flow inverter baffle of claim 3, wherein the central passageway is located between the one or more compressing elements and the first inversion element and is configured to allow the first flow portion to flow upwardly toward the first side of the second dividing panel.

6. The flow inverter baffle of claim 3, further comprising:

one or more windows located in the second dividing panel and configured to recombine the first and second perimeter flow portions with the first flow portion.

7. The flow inverter baffle of claim 1, wherein the first and second perimeter flow portions are recombined prior to reaching the trailing edge of the flow inverter baffle, while the first flow portion remains separate from the first and second perimeter flow portions prior to reaching the trailing edge of the flow inverter baffle.

8. The flow inverter baffle of claim 1, wherein the second and third inversion elements are collectively formed from a single surface.

9. The flow inverter baffle of claim 1, wherein the first dividing panel includes a tapered or sharpened end at the leading edge to help reduce backpressure.

10. The flow inverter baffle of claim 1, wherein the dividing element is centered horizontally with respect to the transverse flow cross-section, such that second flow portion is divided equally between the first and second perimeter flow portions.

11. The flow inverter baffle of claim 1, wherein the dividing element is off-center horizontally with respect to the transverse flow cross-section.

12. The flow inverter baffle of claim 1, wherein the first dividing panel is off-center vertically with respect to the transverse flow cross-section.

13. The flow inverter baffle of claim 1, wherein the one or more compression elements include first and second oppositely angled surfaces which collectively form a funnel-shape to compress the first flow portion.

14. The flow inverter baffle of claim 3, wherein the first and second dividing panels, the one or more compressing elements, the dividing element, and the first, second and third inversion elements are integrally formed as a unitary piece.

15. The flow inverter baffle of claim 3, wherein the first and second dividing panels, the one or more compressing elements, the dividing element, and the first, second, and third inversion elements are injection molded.

16. A static mixer for mixing a fluid flow having at least two components, the static mixer comprising:

a mixer conduit configured to receive the fluid flow;

a plurality of mixing baffles located in the mixer conduit; and at least one flow inverter baffle located in the mixer conduit, each flow inverter baffle further comprising:

a leading edge and a trailing edge, the flow inverter baffle defining a transverse flow cross-section perpendicular to the fluid flow along an entire length between the leading and trailing edges;

a first dividing panel adjacent to the leading edge and having first and second sides, the first dividing panel configured to divide the fluid flow into a first flow portion adjacent the first side of the first dividing panel and a second flow portion adjacent the second side of the first dividing panel;

one or more compressing elements configured to compress the first flow portion;

a first inversion element located downstream of the one or more compressing elements and configured to shift the first flow portion to a different location with respect to the transverse flow cross-section;

a dividing element located adjacent the second side of the first dividing panel and configured to divide the second flow portion into first and second perimeter flow portions;

a second inversion element configured to shift the first perimeter flow portion;

a third inversion element configured to shift the second perimeter flow portion; and a central passageway extending through the flow inverter baffle parallel to the transverse flow cross-section and between the second and third inversion elements along a direction substantially perpendicular to the fluid flow.

17. The static mixer of claim 16, wherein the plurality of mixing baffles comprises alternating mixing baffles including at least one right-handed baffle and at least one left-handed baffle.

18. The static mixer of claim 16, wherein the plurality of mixing baffles and the at least one flow inverter baffle are integrally formed as a unitary piece.

19. The static mixer of claim 16, wherein the plurality of mixing baffles and the at least one flow inverter baffle are formed by injection molding.

20. The static mixer of claim 19, further comprising a conduit sidewall integrally formed with the plurality of mixing baffles and the at least one flow inverter baffle.

21. A method of mixing at least two components of a fluid flow with a static mixer including a mixer conduit and a plurality of mixing baffles including at least one flow inverter baffle, the method comprising:

introducing the fluid flow having at least two components into an inlet end of the mixer conduit; and forcing the fluid flow through the plurality of mixing baffles including the at least one flow inverter baffle to produce a mixed fluid flow, the at least one flow inverter baffle including a leading edge and a trailing edge and defining a transverse flow cross-section perpendicular to the fluid flow along an entire length between the leading and trailing edges, the forcing comprising:

dividing the fluid flow with a first dividing panel adjacent to the leading edge into first and second flow portions, the first flow portion flowing along a first side of the first dividing panel and the second flow portion flowing along a second side of the first dividing panel;

compressing the first flow portion with one or more compressing elements;

inverting the first flow portion through a central passageway extending through the flow inverter baffle parallel to the transverse flow cross-section with a first inversion element located adjacent the first side of the first dividing panel and downstream from the one or more compressing elements to a different location with respect to the transverse flow cross-section;

dividing the second flow portion into first and second perimeter flow portions with a dividing element located adjacent the second side of the first dividing panel;

inverting the first perimeter flow portion with a second inversion element to a different location; and inverting the second perimeter flow portion with a third inversion element to a different location, wherein the central passageway extends between the second and third inversion elements along a direction substantially perpendicular to the fluid flow.

22. The method of claim 21, wherein forcing the fluid flow through the plurality of mixing baffles including the at least one flow inverter baffle further comprises:

shifting the first and second perimeter flow portions using the dividing element prior to inverting the first and second perimeter flow portions, wherein the one or more compressing elements are located adjacent the first side of the first dividing panel prior to inverting the first flow portion.

23. The method of claim 21, wherein:

the flow inverter baffle further comprises a second dividing panel located adjacent to the trailing edge and having first and second sides, the first flow portion is a lower flow portion, the first perimeter flow portion is an upper left flow portion, the second perimeter flow portion is an upper right flow portion, inverting the first flow portion, the first perimeter flow portion, and the second perimeter flow portion comprises:

inverting the first flow portion upwardly with respect to the transverse flow cross-section using the first inversion element located in the second side of the first dividing panel, and then expanding the first flow portion adjacent the second side of the second dividing panel;

inverting the first perimeter flow portion downwardly with respect to the transverse flow cross-section using the second inversion element located in an upper left quadrant, and then adjacent a first wall of the first inversion element; and inverting the second perimeter flow portion downwardly with respect to the transverse flow cross-section using the third inversion element located in an upper right quadrant, and then adjacent a second wall of the first inversion element.

24. The method of claim 21, wherein:

the fluid flow has flow layers, and forcing the fluid flow through the plurality of mixing baffles including the at least one flow inverter baffle further comprises inverting the flow layers of the at least two components while maintaining a general orientation of the flow layers as the fluid flow moves through the at least one flow inverter baffle.

25. The flow inverter baffle of claim 1, wherein the first inversion element is configured to shift an entirety of the first flow portion upwardly to the different location with respect to the transverse flow cross-section.

26. The static mixer of claim 16, wherein the first inversion element is configured to shift an entirety of the first flow portion upwardly to the different location with respect to the transverse flow cross-section.

27. The method of claim 21, wherein inverting the first flow portion with the first inversion element located adjacent the first side of the first dividing panel and downstream from the one or more compressing elements to the different location with respect to the transverse flow cross-section comprises inverting an entirety of the first flow portion upwardly with the first inversion element located adjacent the first side of the first dividing panel and downstream from the one or more compressing elements to the different location with respect to the transverse flow cross-section.

* * * * *